US006230793B1

(12) United States Patent
Sumida

(10) Patent No.: US 6,230,793 B1
(45) Date of Patent: May 15, 2001

(54) INTEGRAL TYPE HEAT EXCHANGER

(75) Inventor: Michitake Sumida, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/018,051

(22) Filed: Feb. 3, 1998

(30) Foreign Application Priority Data

Feb. 6, 1997 (JP) ..... 9-023998

(51) Int. Cl.[7] ..... F28D 7/16
(52) U.S. Cl. ..... 165/140; 165/51
(58) Field of Search ..... 165/140, 67, 51; 180/68.4

(56) References Cited

U.S. PATENT DOCUMENTS

| | | | | |
|---|---|---|---|---|
| 4,274,481 | * | 6/1981 | Ireland et al. | 165/140 X |
| 5,000,257 | | 3/1991 | Shinmura . | |
| 5,033,540 | * | 7/1991 | Tategami et al. | 165/140 X |
| 5,036,910 | | 8/1991 | Wolf . | |
| 5,080,167 | * | 1/1992 | Wolf | 165/140 |
| 5,163,507 | * | 11/1992 | Joshi | 165/140 X |
| 5,186,243 | * | 2/1993 | Halstead | 165/140 X |
| 5,186,246 | * | 2/1993 | Halstead | 165/140 |
| 5,529,116 | | 6/1996 | Sasaki et al. . | |
| 5,671,803 | * | 9/1997 | Tepas et al. | 165/140 X |
| 5,720,341 | | 2/1998 | Watanabe et al. . | |
| 5,915,490 | * | 6/1999 | Wurfel | 180/68.4 X |

FOREIGN PATENT DOCUMENTS

| | | | | |
|---|---|---|---|---|
| 0 367 078 | | 5/1990 | (EP) . | |
| 0 677 716 | | 10/1995 | (EP) . | |
| 202084 | * | 9/1986 | (JP) | 165/140 |
| 247990 | | 10/1989 | (JP) | 165/140 |

* cited by examiner

*Primary Examiner*—Leonard Leo
(74) *Attorney, Agent, or Firm*—Sughrue, Mion, Zinn, Macpeak & Seas, PLLC

(57) ABSTRACT

In an integral type heat exchanger, first and second radiator tanks is opposed to each other, and first and second condenser tanks opposed to each other. The first radiator tank is adjacent to the first condenser tank, and the second radiator tank is adjacent to the second condenser tank. A core section is arranged between the first and second radiator tanks and between the first and second condenser tanks so as to be common between the radiator tanks and condenser tanks. A cooling water flows from the first radiator tank into the second radiator tank through the core section in one direction, and a refrigerant flows between the first and second condenser tanks through the core section repeatedly. And a final flowing direction of the refrigerant conforms with a flowing direction of the cooling water.

2 Claims, 7 Drawing Sheets

INTEGRAL TYPE HEAT EXCHANGER

BACKGROUND OF THE INVENTION

1. Field of the Invention

The present invention relates to an integral type heat exchanger in which a radiator and a condenser are arranged adjacent to each other, and corrugated fins arranged in a core section of the radiator and condenser are jointly used for both radiator and condenser.

2. Description of the Related Art

Recently, they have developed an integral type heat exchanger in which a condenser for a refrigeration system is connected with a radiator on the front surface of the radiator.

FIGS. 7 to 9 are views showing this integral type heat exchanger. In this integral type heat exchanger, the condenser 1 is arranged on the front surface of the radiator 2.

The condenser 1 includes: an upper condenser tank 3; a lower condenser tank 4 opposed to the upper condenser tank 3; and a core section 5 arranged between the upper condenser tank 3 and the lower condenser tank 4. The radiator 2 includes: an upper radiator tank 6; a lower radiator tank 7 opposed to the upper radiator tank 6; and a core section 5 arranged between the upper radiator tank 6 and the lower radiator tank 7.

In this integral type heat exchanger, both tubes 17 used for the condenser and tubes 8 used for the radiator are arranged in the core section 5, and wide corrugated fins 9 are attached to both tubes 17 and 8, so that the corrugated fins 9 are jointly used for both the tubes 17 and 8.

The cooling water inflow pipe 10 is open to the upper radiator tank 6 of the radiator 2, and the cooling water outflow pipe 11 is open to the lower radiator tank 7.

The refrigerant inflow pipe 12 and the refrigerant outflow pipe 13 are open to the upper condenser tank 3 of the condenser 1. As shown in FIG. 9, dividing members 14, 15, 16 to divide the insides of the condenser tanks 3, 4 are arranged in the upper condenser tank 3 and the lower condenser tank 4.

In the radiator 2 of the above integral type heat exchanger, as shown in FIG. 8, cooling water flows into the upper radiator tank 6 from the cooling water inflow pipe 10. Cooling water is cooled while it is flowing in the tubes 8. Then, cooling water flows into the lower radiator tank 7 and is discharged outside from the cooling water outflow pipe 11.

On the other hand, as shown in FIG. 9, refrigerant flows in the condenser 1 as follows. Refrigerant flows from the refrigerant inflow pipe 12 into the condenser tank 3 and passes in the tubes 17. Then refrigerant flows into the lower condenser tank 4. Refrigerant repeatedly flows into the upper condenser tank 3 and the lower condenser tank 4 through the tubes 17 by the action of the dividing members 14, 15, 16. While refrigerant is flowing in the tubes 17, it is cooled and finally discharged outside from the refrigerant outflow pipe 13 of the upper condenser tank 3.

Since the refrigerant outflow pipe 13 is arranged in the upper condenser tank 3 in the above condenser 1, only liquid refrigerant, which has been sufficiently condensed, can flow out from the refrigerant outflow pipe 13.

However, the following problems may be encountered in the above conventional integral type heat exchanger. In the above integral type heat exchanger, the corrugated fins 9 are jointly used in the core section 5 of the radiator 2 and the condenser 1. The cooling water inflow pipe 10 into which cooling water of relatively high temperature flows is arranged in the upper radiator tank 6, and the refrigerant outflow pipe 13 from which cooled and condensed refrigerant flows out is arranged in the upper condenser tank 3. Therefore, in the upper portion of the core section 5, heat is transmitted from the cooling water of relatively high temperature in the radiator 2 to the refrigerant of relatively low temperature which has been cooled and condensed by the condenser 1. Due to the transmission of heat, the cooling performance of the condenser 1 is deteriorated.

SUMMARY OF THE INVENTION

The above problems can be solved by the present invention. It is an object of the present invention to provide an integral type heat exchanger by which the deterioration of cooling performance of the condenser caused by the thermal influence of cooling water flowing in the radiator can be greatly reduced as compared with the integral type heat exchanger of the conventional art.

In an integral type heat exchanger according to the present invention, first and second radiator tanks are opposed to each other, and first and second condenser tanks are opposed to each other. The first radiator tank is adjacent to the first condenser tank, and the second radiator tank is adjacent to the second condenser tank. A core section is arranged between the first and second radiator tanks and between the first and second condenser tanks so as to be common between the radiator tanks and condenser tanks. A cooling water flows from the first radiator tank into the second radiator tank through the core section at least in one direction, and a refrigerant flows between the first and second condenser tanks through the core section repeatedly. And a final flowing direction of the refrigerant in the core section conforms with a flowing direction of the cooling water.

The above integral type heat exchanger preferably includes a cooling water inflow pipe being open to the second radiator tank, a cooling water outflow pipe being open to the first radiator tank, and a refrigerant outflow pipe being open to the first condenser tank.

In the radiator in the integral type heat exchanger according to the present invention, cooling water flows into the second radiator tank from the cooling water inflow pipe. While cooling water is flowing in the tubes, it is cooled. After that, cooling water flows into the first radiator tank and flows out from the cooling water outflow pipe.

On the other hand, in the condenser, refrigerant flows from the refrigerant inflow pipe into the first or the second condenser tank. After that, it is cooled while it is flowing in the tubes. Finally, refrigerant flows outside from the refrigerant outflow pipe of the first condenser tank opposed to the first radiator tank.

DETAILED DESCRIPTION OF THE PREFERRED EMBODIMENTS

Referring to accompanying drawings, an embodiment of the present invention will be explained in detail as follows.

Figure 1:
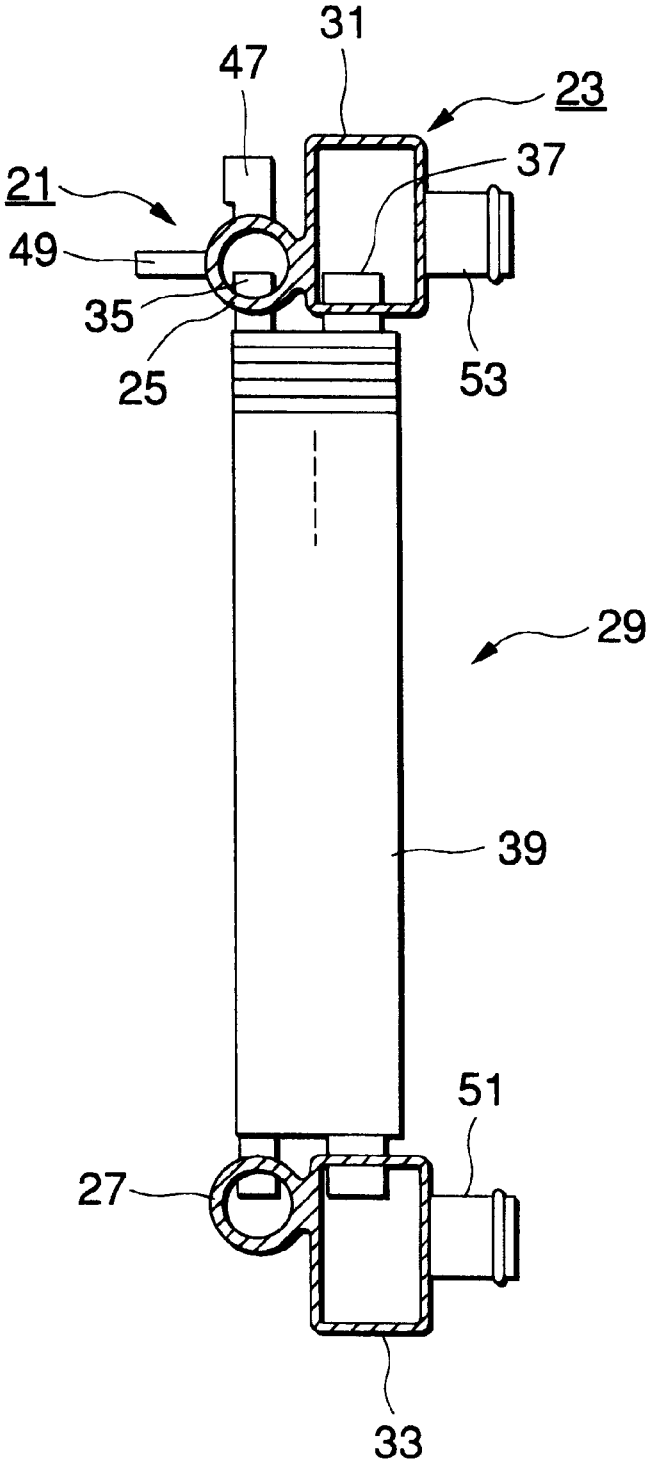
FIG. 1 is a transversely cross-sectional view of an embodiment of the integral type heat exchanger according to the present invention.
Figure 2:
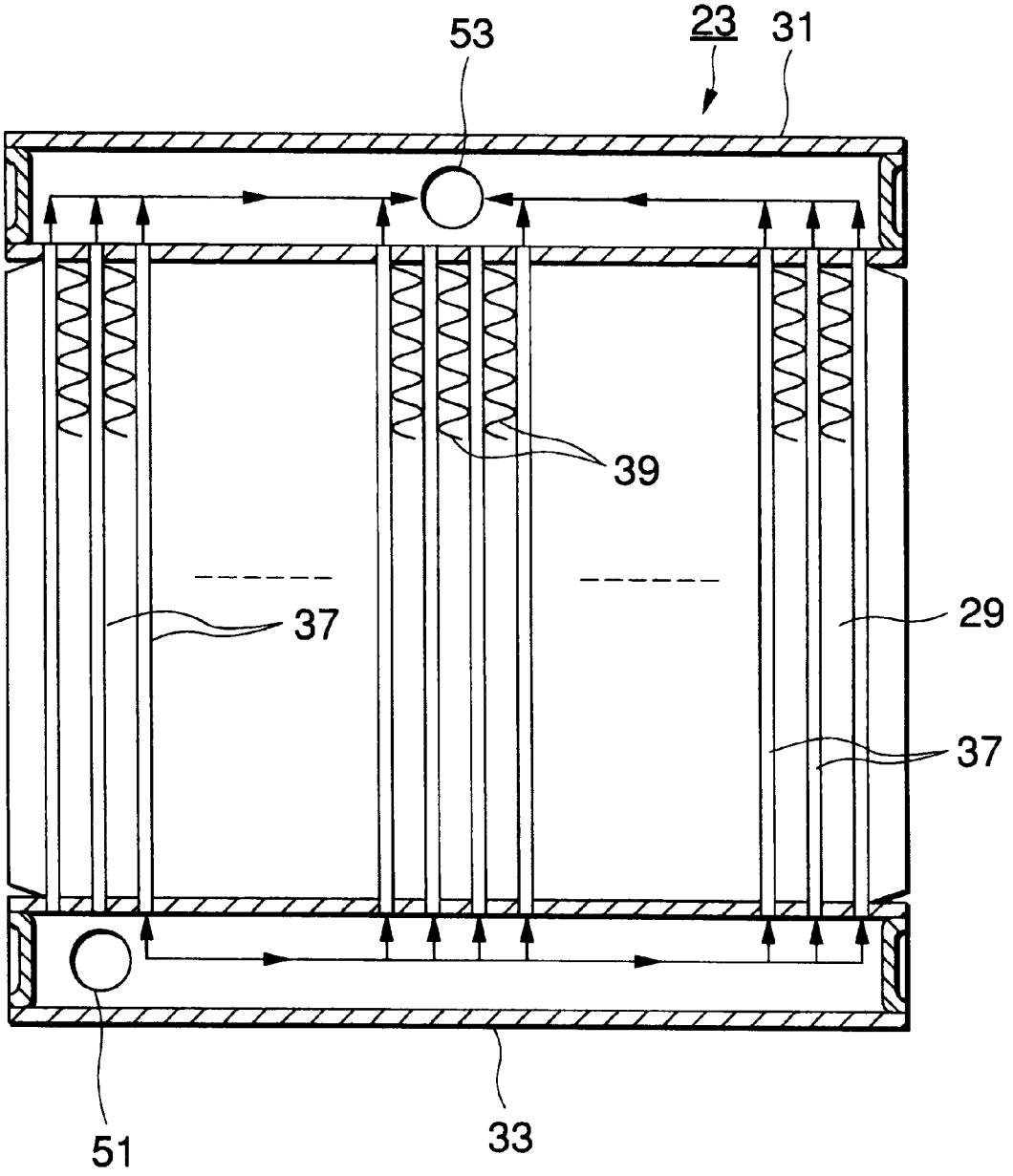
FIG. 2 is a longitudinally cross-sectional view of the radiator shown in FIG. 1.
Figure 3:
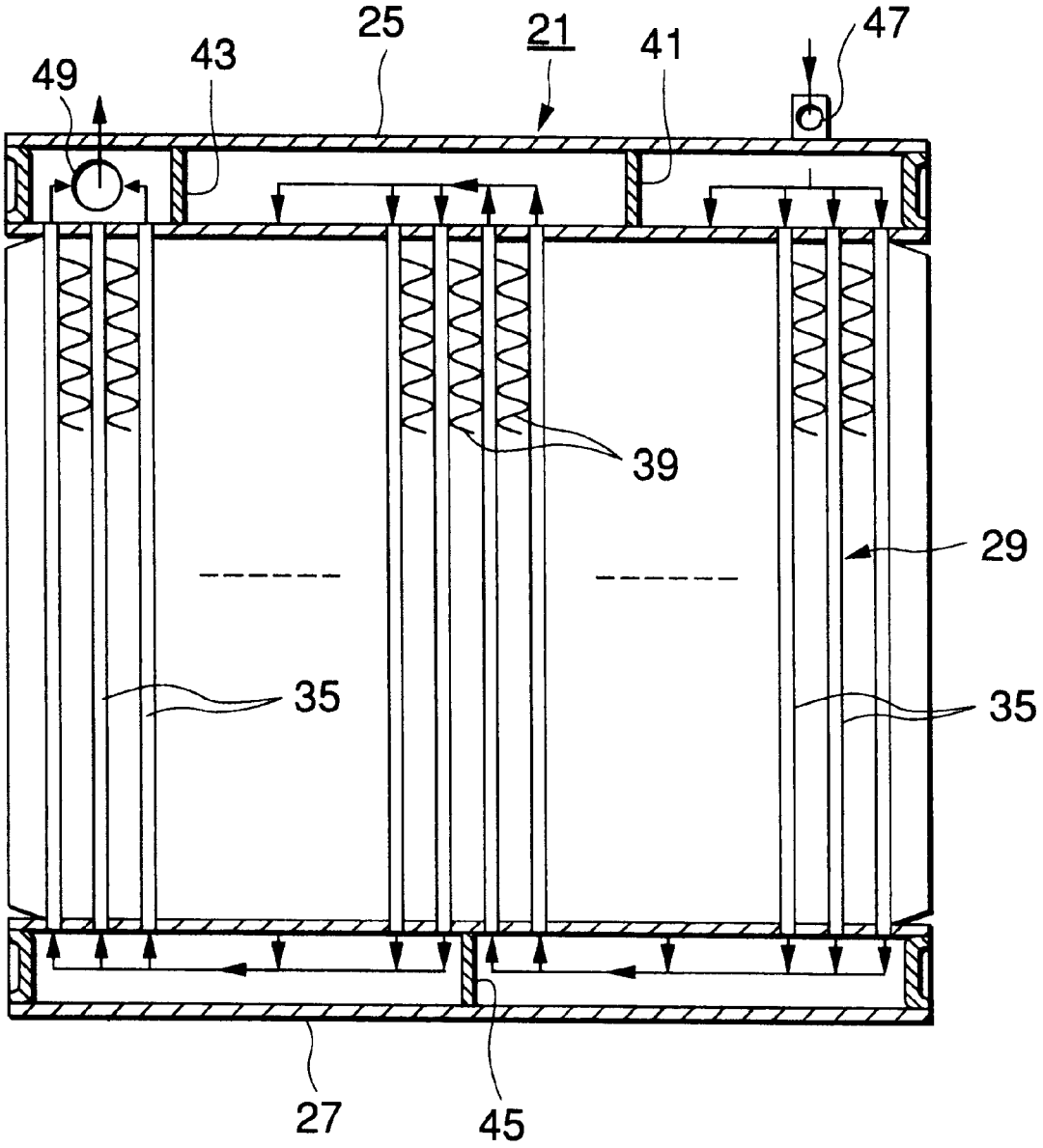
FIG. 3 is a longitudinally cross-sectional view of the condenser shown in FIG. 1.

FIGS. 1 to 3 show an embodiment of the integral type heat exchanger of the present invention.

In this integral type heat exchanger, the condenser 21 is arranged on the front surface of the radiator 23.

The condenser 21 includes: an upper (second) condenser tank 25; a lower (first) condenser tank 27 opposed to the upper condenser tank 25; and a core section 29 arranged between the upper condenser tank 25 and the lower condenser tank 27.

The radiator 23 includes: an upper (second) radiator tank 31; a lower (first) radiator tank 33 opposed to the upper radiator tank 31; and a core section 29 arranged between the upper radiator tank 31 and the lower radiator tank 33.

Tubes 35 used for the condenser 21 and tubes 37 used for the radiator 23 are arranged in the core section 29.

Wide corrugated fins 39 are attached to both tubes 35, 37 by brazing, so that the corrugated fins 39 can be jointly used for both tubes 35, 37.

In this embodiment, the upper condenser tank 25, upper radiator tank 31, lower condenser tank 27 and lower radiator tank 33 are made of aluminum and integrally formed by means of extrusion molding.

The upper condenser tank 25 and lower condenser tank 27 are respectively formed into a cylindrical shape, and the upper radiator tank 31 and lower radiator tank 33 are respectively formed into a rectangular-cylindrical shape.

As shown in FIG. 3, dividing members 41, 43 are arranged in the upper condenser tank 25 and the two dividing members 41, 43 are located by a predetermined distance apart. A dividing member 45 is arranged at a position in the lower condenser tank 27 between the dividing members 41, 43.

There are provided a refrigerant inflow pipe 47 and a refrigerant outflow pipe 49 on both sides of the upper condenser tank 25 of the condenser 21 in this embodiment.

There is provided a cooling water inflow pipe 51 in the lower radiator tank 33 of the radiator 23. There is provided a cooling water outflow pipe 53 in the upper radiator tank 31.

As shown in FIG. 2, cooling water flows in the radiator 23 in this integral type heat exchanger as follows. Cooling water flows from the cooling water inflow pipe 51 into the lower radiator tank 33. While cooling water is flowing in the tubes 37, it is cooled. After that, cooling water flows into the upper radiator tank 31 and flows outside from the cooling water outflow pipe 53.

On the other hand, as shown in FIG. 3, refrigerant flows in the condenser 21 as follows. Refrigerant flows from the refrigerant inflow pipe 47 into the upper condenser tank 25. After that, it flows in the tubes 35. Then, refrigerant flows into the lower condenser tank 27. By the action of the dividing members 41, 43, 45, refrigerant repeatedly flows into the upper condenser tank 25 and the lower condenser tank 27. While it is flowing in the tubes 35, refrigerant is cooled and finally discharged outside from the refrigerant outflow pipe 49 of the upper condenser tank 25.

In the integral type heat exchanger constituted as described above, the cooling water inflow pipe 51 into which cooling water of relatively high temperature flows is open to the lower radiator tank 33, and the refrigerant outflow pipe 49 from which cooled and condensed refrigerant flows out is open to the upper condenser tank 25. Since the temperature of cooling water in the upper portion of the core section 29 in the radiator 23 is relatively low, the deterioration of cooling performance of the condenser 21 caused by the thermal influence of cooling water in the radiator 23 can be greatly reduced.

That is, although the refrigerant of the condenser 21 flows in the condenser 21 upwardly and downwardly repeatedly, at least, the final flowing direction of the refrigerant in the core section conforms with the flowing direction of the cooling water of the radiator 23. That is, if only the final flowing direction of the refrigerant in the core section conforms with the flowing direction of the cooling water of the radiator, the effect of the present invention can be achieved.

In the above embodiment, the refrigerant inflow pipe 47 is open to the upper condenser tank 25. However, it should be noted that the present invention is not limited to the above specific embodiment, but .the refrigerant inflow pipe may be open to the lower condenser tank 27.

Of course, both the refrigerant inflow and outflow pipes 47, 49 may be open to the lower condenser tank 27, however, in this case, the cooling water inflow pipe is provided in the upper radiator tank of the radiator, and the cooling water outflow pipe is provided in the lower radiator tank. Also in this case, the final flowing direction of the refrigerant in the core section conforms with the flowing direction of the cooling water of the radiator at least.

Figure 4:
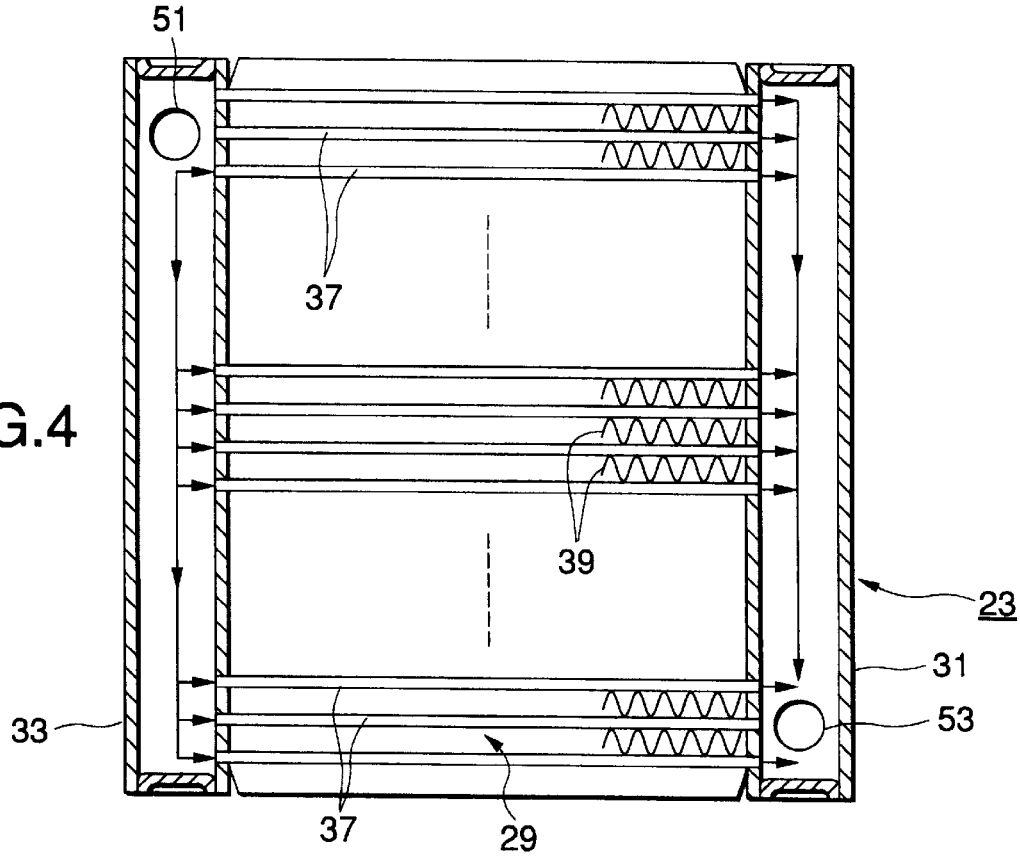
FIG. 4 is a longitudinally cross-sectional view of the radiator in the another type of the integral type heat exchanger.
Figure 5:
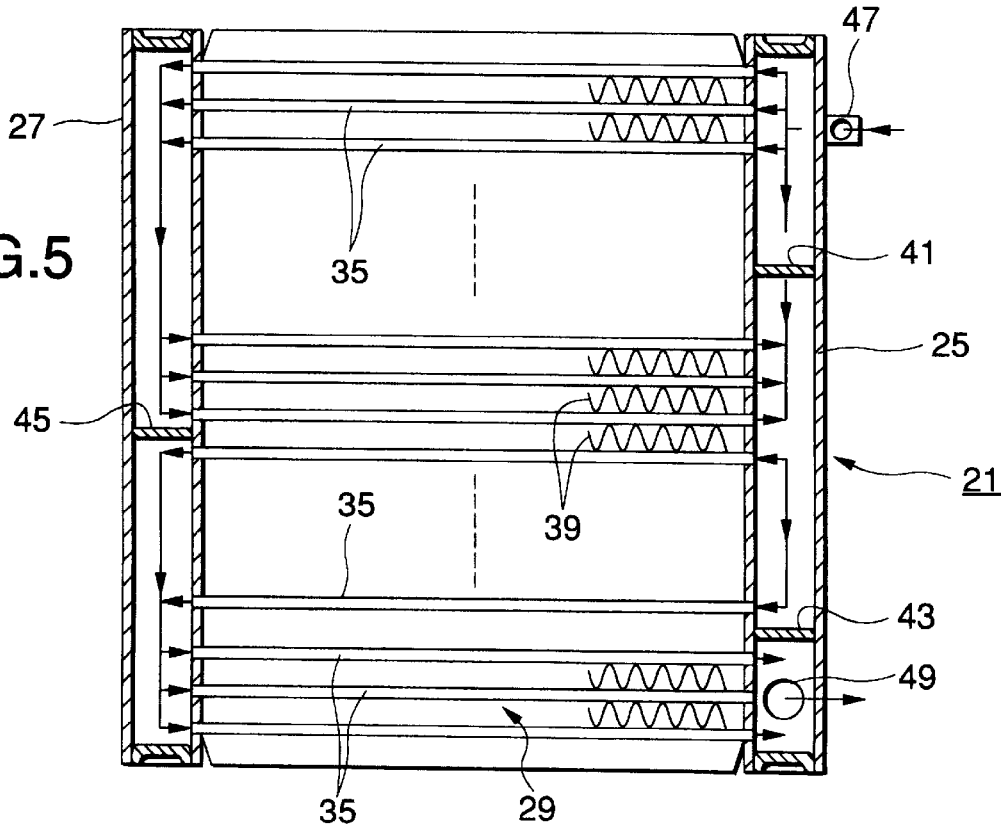
FIG. 5 is a longitudinally cross-sectional view of the condenser in the another type of the integral type heat exchanger.

Although in the above embodiment, the present invention is applied to a down-flowing type heat exhanger in which the refrigerant and cooling water flow in the vertical direction, it should be noted that the present invention is not limited to the above specific embodiment, but the present invention can also be applied to a cross-flowing type heat exchanger in which the refrigerant and cooling water flow in the lateral direction as shown in FIGS. 4 and 5. Also in this case, the final flowing direction of the refrigerant in the core section conforms with the flowing direction of the cooling water of the radiator at least.

Figure 6:
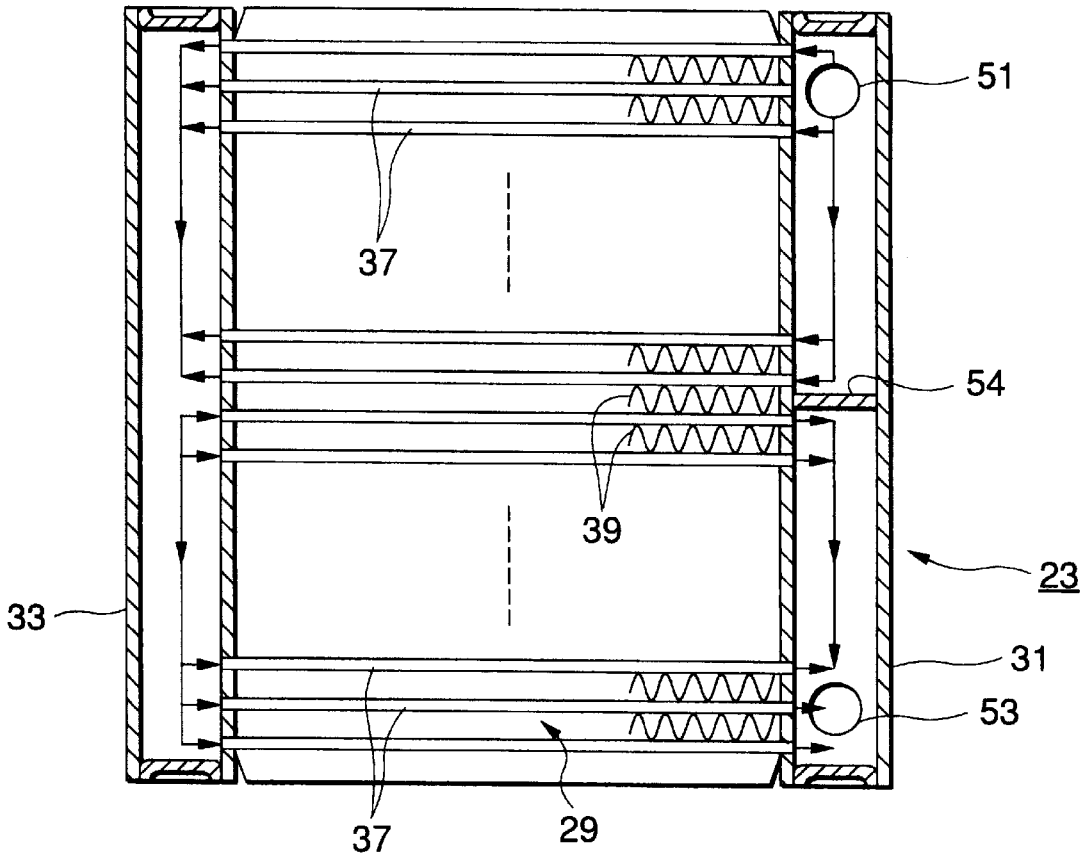
FIG. 6 is a longitudinally cross-sectional view of the radiator in the still another type of the integral type heat exchanger.
Figure 7:
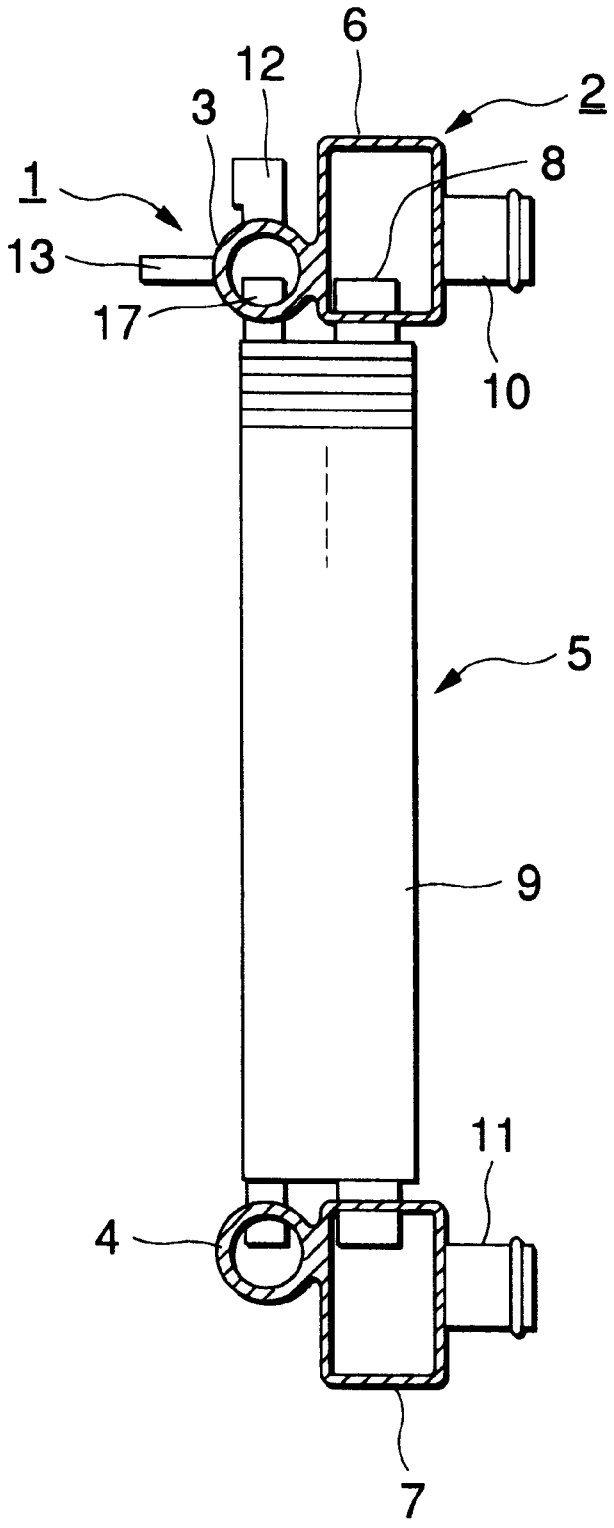
FIG. 7 is a transversely cross-sectional view of the integral type heat exchanger.
Figure 8:
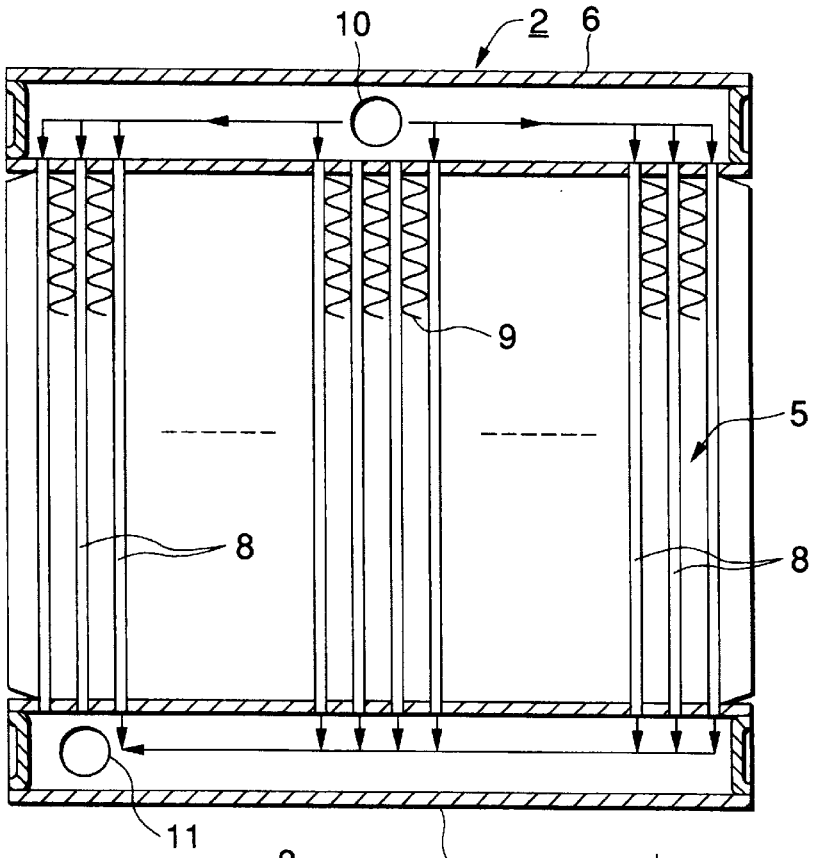
FIG. 8 is a longitudinally cross-sectional view of the radiator shown in FIG. 7.
Figure 9:
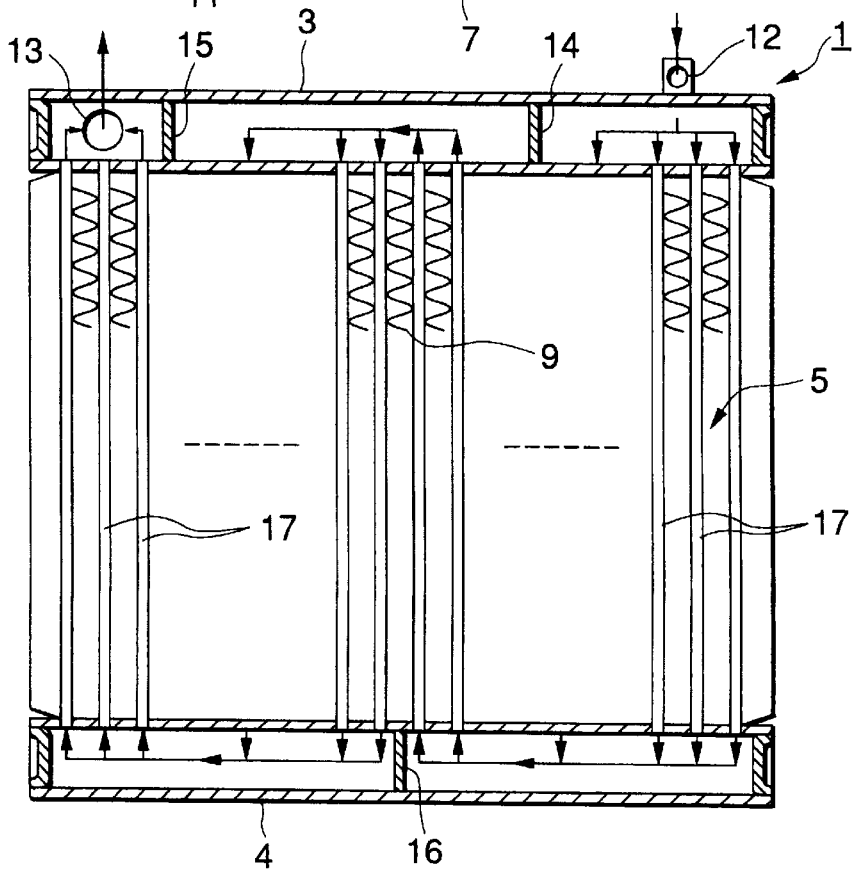
FIG. 9 is a longitudinally cross-sectional view of the condenser shown in FIG. 7.

Further, in the aforementioned embodiments, the present invention is applied to the radiator 23 in which the cooling water flows only in one direction from the lower (first) radiator tank 33 to the upper (second) radiator tank 31. However, the cooling water can be flown repeatedly in the core section as shown in FIG. 6 by providing a dividing member 54 in the second radiator tank 31. The number of the dividing members can be set arbitrarily. Also in this case, the final flowing direction of the refrigerant in the core section conforms with the flowing direction of the cooling water of the radiator at least by assembling this radiator with the condenser 21 as shown in FIG. 5.

Still further, in the above embodiment, the upper condenser tank 25 and the upper radiator tank 31 are integrated into one body, and the lower condenser tank 27 and the lower radiator tank 33 are integrated into one body so as to form an integral type heat exchanger to which the present invention is applied. However, it should be noted that the present invention is not limited to the above specific embodiment, but it is possible to apply the present invention to an integral type heat exchanger in which the upper condenser tank and the upper radiator tank are formed separately from each other, and the lower condenser tank and the lower radiator tank are also formed separately from each other.

As described above, in the integral type heat exchanger according to the present invention, the cooling water inflow pipe into which cooling water of relatively high temperature flows is open to the lower radiator tank, and the refrigerant outflow pipe from which cooled and condensed refrigerant flows out is open to the upper condenser tank. Since the temperature of cooling water in the radiator is relatively low in the upper portion of the core section due to the above arrangement, the deterioration of cooling performance of the condenser caused by the thermal influence of cooling water in the radiator can be greatly reduced.

What is claimed is:

1. A system comprising:

a cooling water path in which a cooling water circulates through an engine and a radiator, said radiator having upper and lower tanks extended in a horizontal direction and opposed to each other;

a refrigerant path in which a refrigerant circulates through an expansion valve, an evaporator, a compressor, and a condenser, said condenser having upper and lower tanks extended in the horizontal direction and opposed to each other, said upper radiator tank being adjacent to said upper condenser tank and said lower radiator tank being adjacent to said lower condenser tank;

a core section arranged between said upper radiator tank and said lower radiator tank as well as between said upper condenser tank and said lower condenser tank so as to be common between said radiator tanks and said condenser tanks, said core section comprising (1) a plurality of radiator tubes extended between said upper radiator tank and said lower radiator tank in a vertical direction and being conducted to said upper radiator tank and said lower radiator tank, and (2) a plurality of condenser tubes extended between said upper condenser tank and said lower condenser tank in the vertical direction and being conducted to said upper condenser tank and said lower condenser tank, said condenser tubes being separate from said radiator tubes;

a cooling water inflow pipe being open to said lower radiator tank and coupled to said engine;

a cooling water outflow pipe being open to said upper radiator tank and coupled to said engine;

a refrigerant inflow pipe being open to one of said upper condenser tank and said lower condenser tank and coupled to said compressor; and a refrigerant outflow pipe being open to said upper condenser tank and coupled to said expansion valve;

wherein the cooling water enters into said cooling water inflow pipe from said engine, flows through said lower radiator tank, said radiator tubes, said upper radiator tank, and said cooling water outflow pipe to return to said engine; and wherein the refrigerant enters into said refrigerant inflow pipe from said compressor, flows through said upper condenser tank, said condenser tubes, said lower condenser tank, and said refrigerant outflow pipe after returning to said upper condenser tank from said lower condenser tank to said expansion valve, such that a final flowing direction of the refrigerant conforms with a final flowing direction of the cooling water in said core section.

2. The integral type heat exchanger according to claim 1, wherein said refrigerant inflow pipe is open to said upper condenser tank.

* * * * *